United States Patent [19]

Berman

[11] Patent Number: 4,902,019

[45] Date of Patent: Feb. 20, 1990

[54] GAMING LAYOUT ARRANGEMENTS HAVING JACKPOT AREAS

[75] Inventor: Robert Berman, 1227 Gordon Rd., Jenkintown, Pa. 19046

[73] Assignees: John A. DePasquale, New York, N.Y.; George Bradbury, Southport, Conn.; Robert Berman, Jenkintown, Pa.

[21] Appl. No.: 285,429

[22] Filed: Dec. 15, 1988

[51] Int. Cl.[4] ..... A63F 3/00

[52] U.S. Cl. ..... 273/256; 273/138 R; 273/272; 273/274; 273/374; 273/409

[58] Field of Search ..... 273/274, 309, 409, 138 R, 273/256, 272; D21/21, 37

[56] References Cited

U.S. PATENT DOCUMENTS

| | | | |
|---|---|---|---|
| 103,774 | 5/1870 | Plumb | 273/138 R X |
| D. 158,996 | 6/1950 | Packard . | |
| D. 246,732 | 12/1977 | Picataci | D21/37 |
| D. 266,859 | 11/1982 | Skender | D21/37 |
| D. 270,361 | 8/1983 | de Gregorio et al. | D21/37 X |
| 1,663,385 | 3/1928 | Reinheimer . | |
| 3,661,389 | 5/1972 | Harris et al. . | |
| 3,829,098 | 8/1974 | Umminger | 273/274 X |
| 4,230,316 | 10/1980 | Harper | 273/93 R |
| 4,241,924 | 12/1980 | Arcara | 273/409 X |
| 4,635,938 | 1/1987 | Gray | 273/274 |
| 4,746,126 | 5/1988 | Angileri | 273/249 |

FOREIGN PATENT DOCUMENTS

| | | | |
|---|---|---|---|
| 653227 | 12/1962 | Canada | 273/428 |
| 4141 | of 1895 | United Kingdom | 273/274 |

*Primary Examiner*—Anton O. Oechsle
*Attorney, Agent, or Firm*—Cobrin, Feingertz & Gittes

[57] ABSTRACT

Gaming layout arrangements having jackpot areas and methods therefor are provided in accordance with the present invention. One or more geometric forms are established on a traditional gaming layout where markers such as dice are employed in normally playing the game. When a marker employed in playing the game happens to land within a geometric form associated with a jackpot, a jackpot condition is defined. The size, shape, number and value of each geometric form may be varied to define the value and probability of achieving a jackpot condition.

28 Claims, 1 Drawing Sheet

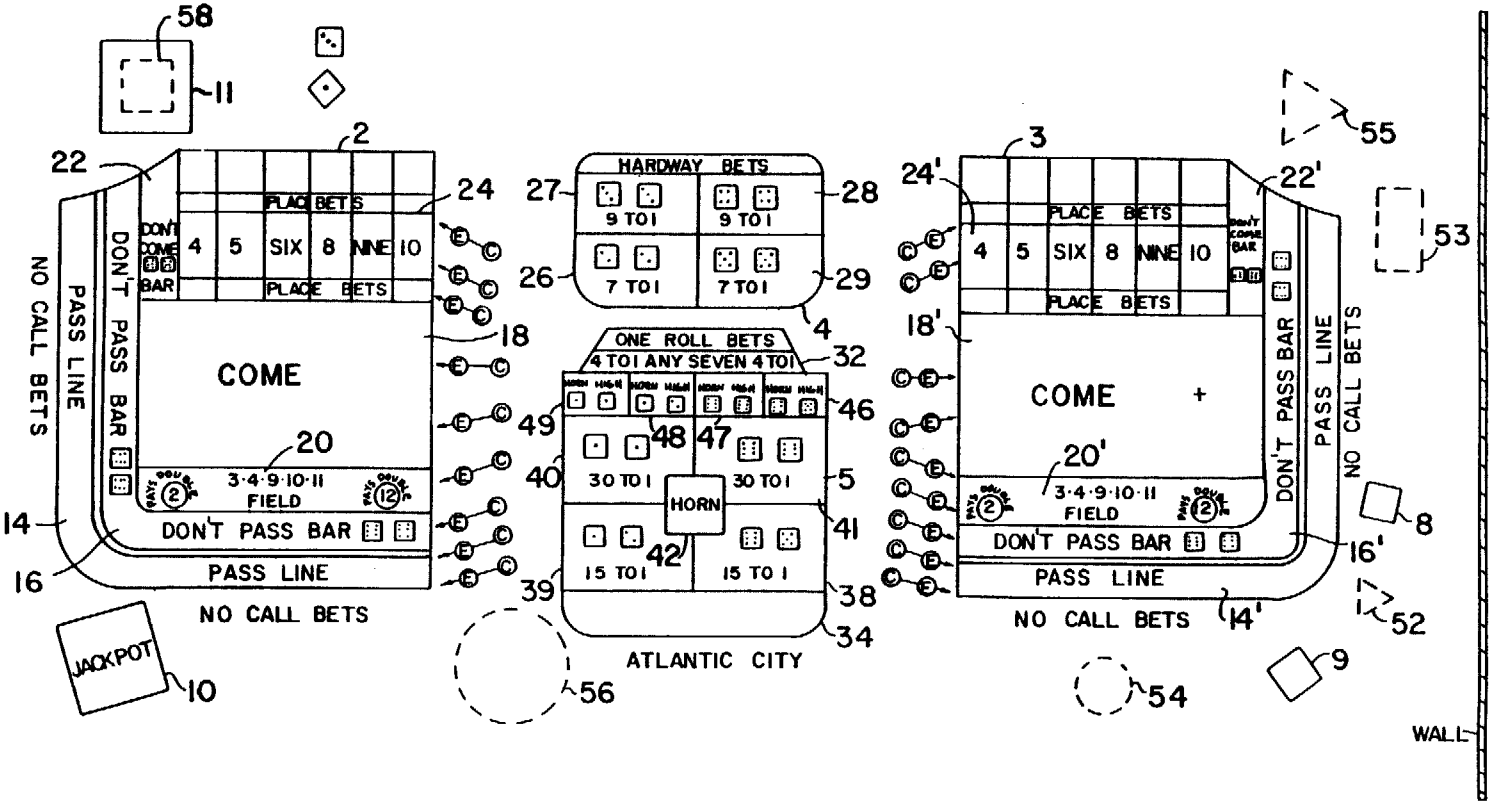
WALL
NO CALL BETS
PASS LINE
DON'T PASS BAR
PLACE BETS
4 5 SIX 8 NINE 10
COME
3·4·9·10·11 FIELD
DON'T PASS BAR
PASS LINE
NO CALL BETS
HARDWAY BETS
9 TO 1
7 TO 1
ONE ROLL BETS
4 TO 1 ANY SEVEN 4 TO 1
30 TO 1
15 TO 1
HORN
ATLANTIC CITY
JACKPOT

GAMING LAYOUT ARRANGEMENTS HAVING JACKPOT AREAS

BACKGROUND OF THE INVENTION

This invention relates to a gaming layout having jackpot areas and more particularly to a gaming layout arrangement which permits conventional games employing dice or other well known forms of markers to be played in a traditional manner while introducing a jackpot concept thereto.

The magical allure of being able to "Hit The Jackpot" has always held special fascination for the populous as a whole. This fascination has been employed by government to impose painless taxes in the form of lotteries and by legalized gambling establishments to attract clientele from their competitors by providing special gaming devices such as slot machines with the capability of providing a win which is disproportionately large with respect to the amount ventured.

The same allure is employed by sales organizations to develop consumer interest by providing sweepstakes, or lottery prizes. Here entry in the sweepstakes or lottery is relied upon to attract those solicited to the products, such as magazines, being offered for sale. Typically, an extremely large payoff or jackpot is available at no charge but instead the mere possibility of the jackpot is relied upon as a lodestone to attract consumer interest.

In states such as Nevada and New Jersey having legalized gambling, competition among casinos and the like in attracting clientele to gaming establishments has always been quite fierce. Such competition has generally proceeded in terms of the magnificence of the establishment, incentives provided to patrons and to a limited extent jackpots made available through specialized gaming devices such as slot machines. However, the ability to compete in terms of the magnificence of the establishment and incentives provided to patrons quickly becomes saturated due to practical considerations.

Jackpots provided on specialized gaming devices do not present a continued attraction to a patron. This occurs since regular patrons of such establishments will generally not continue to be attracted to a gaming device whose sole ability is to provide a jackpot since the odds associated therewith are inordinately high and these devices do not otherwise provide patron satisfaction.

Heretofore, the ability to inject the aura of a jackpot into conventional gaming equipment has been highly limited. This has resulted since conventional gaming arrangements cannot be provided with the possibility of winning a jackpot without a major modification of the game arrangement and in fact a changing of the way or rules by which the game is played. In addition, only traditional forms of gaming have wide appeal to patrons. Jackpot arrangements which occur as a result of conditions which do not involve the patron have always been somewhat suspect.

Therefore it is a principal object of the present invention to provide a gaming layout arrangement having jackpot areas which permit a traditional game to be played in the normal manner while providing the availability of jackpots.

A further object of this invention is to provide gaming layout arrangements having jackpot areas wherein the magnitude and probability of obtaining a jackpot may be varied at will without any effect on the game associated therewith or the manner in which the same is played.

An additional object of the present invention is to provide techniques for injecting jackpot considerations into board games wherein dice are thrown in the normal manner of conducting the game.

A further object is to provide a gaming layout having a simple means for resolving player disputes.

Various other objects and advantages of the present invention will become clear from the following detailed description of an exemplary embodiment thereof and the novel features will be particularly pointed out in conjunction with the claims appended hereto.

SUMMARY OF THE INVENTION

In accordance with the teachings of the present invention gaming layout arrangements having jackpot areas and methods therefor are provided wherein one or more geometric forms are established on a traditional gaming layout where markers such as dice are employed in normally playing the game; when a marker employed in playing the game happens to land within a geometric form associated with a jackpot, an extra large prize (e.g., jackpot) condition is defined; the size, shape, number and value of each geometric form may be varied to define the value and probability of achieving a jackpot condition.

BRIEF DESCRIPTION OF THE DRAWING

The invention will more clearly understood by reference to the following detailed description of an exemplary embodiment thereof in conjunction with the accompanying drawing wherein:

The FIGURE is a top plan view of a conventional Craps gaming layout arrangement having exemplary jackpot areas according to the instant invention imposed thereon.

DETAILED DESCRIPTION

The exemplary embodiment of the present invention is described below in connection with application to a conventional Craps gaming layout. In fact, the portions of the Craps layout arrangement illustrated in the FIGURE is the Craps layout employed in Atlantic City and approved by the New Jersey Gaming Commission. However, those of ordinary skill in the art shall appreciate from the disclosure set forth herein that the concepts of the instant invention may be utilized with any gaming arrangement wherein markers are thrown on a gaming layout mat or board game.

This invention has the unique capability of allowing gaming arrangements to be played in the traditional manner without affecting the style of play, rate of play, odds of play or rules thereof in any manner while the ability to win a jackpot is determined independently of the play of the game and results merely as a function of the ending location of one or more thrown markers. Furthermore, while the markers primarily discussed herein shall be dice, those of ordinary skill in the art will appreciate that any marker could in fact be employed. Thus, if dice are used the concepts of the instant invention may be applied to any game layout associated therewith from Craps to the game MONOPOLY while in other forms of board games the defined jackpot areas may be accessed through other forms of markers.

For example, in a board game such as the game SCRABBLE, jackpot areas may be defined on the board per se and accessed by lettered squares which are tossed on the board at the initial portion of the game. Furthermore, while, as shall be seen below, the jackpot areas illustrated in the FIGURE have been shown as squares to resemble the face of a die any geometric shape such as a rectangle, circle, triangle, parallelogram, or the like may be employed as well.

In addition, as shall also be seen below, the size and location of the jackpot areas may be modified to suit choice of design and in this regard it should be noted that a size variation and graduation may be utilized to modify the odds associated with acquiring a particular jackpot. Further, value indicators such as numerals may be placed within one or more of the jackpot areas to indicate jackpots of enhanced and/or decreased value. Thus, when a marker, used in the ordinary course of playing the game lands in a defined jackpot area, a jackpot as defined by the area may be won. If desired, those persons at a particular table could win a fixed sum (e.g., $50) when a jackpot is won, even though they did not throw the dice.

Referring now to the drawing, there is shown a Craps gaming layout mat having particular jackpot areas superimposed thereon. More particularly, the gaming layout mat having jackpot areas illustrated in the FIGURE comprises a traditional gaming arrangement which is illustrated for example as a Craps layout having an exemplary pattern of betting possibilities distributed in four groupings 2-5 and exemplary jackpot areas 8-11 superimposed thereon. Those of ordinary skill in the art will appreciate that the gaming layout including the exemplary jackpot areas 8-11 will typically be silk-screened on appropriate material such as felt for the gaming arrangement in question. Should a game such as the game MONOPOLY be involved the exemplary jackpot areas 8-11 would be superimposed on the gaming board per se. However, since a Craps gaming arrangement is here being discussed, the gaming layout mat having jackpot areas illustrated in the FIGURE would typically be formed on an elongated felt mat roughly the size of a billiard table so that the same may be replacably mounted on a conventional Craps table or the like.

The pattern of betting the possibilities illustrated in the FIGURE for the exemplary Craps gaming arrangement is, as indicated, representative of the Craps gaming arrangement employed in Atlantic City, New Jersey and approved by the New Jersey Gaming Commission. Those of ordinary skill of the art will appreciate that the pattern of the betting possibilities printed in a Craps gaming arrangement will vary with local or regional regulations or policy and will never include all possible bets. Each of these arrangements, however, are generally similar and as shall be apparent below, the particular arrangement involved or in fact the game selected for use in conjunction with the superimposed jackpot areas 8-11 in no way affects the instant invention so long as markers such as dice are thrown in the gaming arrangement employed.

For the particular Craps gaming arrangement illustrated in the FIGURE corresponding, symmetrical, first and second possibility groupings 2 and 3 are disposed at each end of the elongated layout. Those of ordinary skill in the art will recognize that the betting possibility groupings 2 and 3 are those most frequently utilized directly by players while the central betting possibility groupings 4 and 5 are less widely used and frequently accessed by the stickman or dealers. Therefore, groupings 4 and 5 need not be accessible to all players gathered around the table.

Each of the betting possibility groupings 2 and 3 comprise a Pass Line area 14 and 14' and a Do Not Pass Bar area 16 and 16'. The Pass Line area 14 and 14' is, as is well known to those of ordinary skill in the art, for betting with the shooter. Conversely, the Do Not Pass Bar area 16 and 16' is for betting against the shooter. Both Pass and Do Not Pass are bets which are typically placed before the shooters initial roll or "Coming Out". Technically Pass bets may be made at any time before a Decision is reached. Supplemental to the coming out roll, Free or Full Odds may be placed behind the Pass Line in the manner well known to those of ordinary skill in the art.

Come bets are placed in the Come area annotated 18 and 18'. This effectively provides a Come Line strategically disposed for access by each of the players. Come bets, as also well known to those of ordinary skill in the art, are technically the equivalent of a Pass bet made after the shooters first roll. Here the shooter's next roll is treated as if it is the initial or Coming Out roll. When free odds are provided for Come bets the same are normally implemented by placing the Odds chips on top, but off center, on the chips representing the Come bet. Thus, no separate area for Free odds associated with Come bets ar provided.

A field box 20 and 20' is also provided within each of the betting possibility groupings 2 and 3 where field bets may be placed. This is located, as indicated, on the player's side of the come area 18 and 18' and displays the numbers 2-4 and 9-12. A Double Pay condition is indicated for the 2 and 12 present in the field box. A field bet is a bet that the next roll will produce any field number.

Each of the betting possibility groupings 2 and 3 also are provided with a Do Not Come Bar area 22 and 22'. A bet placed in the Do Not Come Bar area 22 or 22' relates to a Come bet as the Do Not Pass Bar Line relates to the Pass Line. The betting possibility groupings 2 and 3 are also provided with a Place Field 24 and 24'. The Place Field 24 and 24' includes locations marked for the numerals 4, 5, 6, 8, 9 and 10 as well as locations, as indicated, where Place bets may be set. A Place bet, as well known to those of ordinary skill in the art, is a bet that a particular box number, i.e. 4, 5, 6, 8, 9 or 10 will be rolled before a 7. In addition, again as well known to those of ordinary skill in the art, the Place Field 24 and 24' is provided with chip location areas in association with each numeral marked in the Place Field. Here points associated with previously made Come bets are kept track of by relocation of the chips, with or without odds, associated with the Come bet into the rectangular area in the Place Field associated with the number that represents the Point.

The betting possibility grouping 4 is devoted, as indicated, to Hardway bets. Hardway bets, as well known to those of ordinary skill in the art, are associated with numerals that may be made by a pair of corresponding die configurations (2-2, 3-3, 4-4, or 5-5) as well as a pair of non corresponding numerals (1-3, 3-1, 1-5, 5-1, 4-2, 2-4, 2-6, 6-2, 5-3, 3-5, 4-6, and 6-4,) wherein the former set corresponds to the "Hardway". When a Hardway bet is made the Hardway number must appear both before a 7 and before the desired number is produced by an unwanted combination. For example a Hardway 6 is won if a 3-3 combination is rolled prior to a 7, a 1-5, a 5-1, a 4-2, and a 2-4. Each of the 4 Hardway bets are depicted by the die markers in blocks 26–29.

Betting possibility grouping 5, as illustrated in the FIGURE, is devoted to various One Roll bets indicating that the wager made is won or lost in the next roll of the dice. Of this group block 32 is devoted to an "Any Seven" while block 34 is devoted to an "Any Craps". Thus, a bet in block 32 wins if the next roll of the dice produces a 7. Similarly a bet in block 34 wins if the next roll produces a 2, 3 or 12.

The four blocks 38–41 associated with the block 42 annotated Horn define a conventional Horn bet grouping. Thus, here the wager is won if on the next roll of the dice a 2, 3, 11 or 12 occurs. With the higher odds indicated in the blocks 38–41 the bet pays only on the winning quarter of the wager and the remaining three quarters of the original bet is lost. Finally, as indicated by the blocks 46–49 "High Horn" betting possibilities are also provided. Here, the amount of the Horn wager, as well known to those of ordinary skill of the art, is slanted in percentage to a specific one of the four Horn bet combinations.

The manner in which jackpot areas are superimposed on the traditional Craps betting layout is described in connection with the jackpot areas 8–11 illustrated in the FIGURE. The jackpot areas 8 and 9 are illustrated as squares whose size may be slightly larger than the surface area of a die face, for example exceeding that of the die face by a quarter of an inch per side. Similarly, jackpot areas 10 and 11 are illustrated as squares whose area may be considered 3 to 4 times the size of a die face. The location of the jackpot areas 8–11 is wholly arbitrary, however, it is preferred that the same not directly overlie any of the betting possibility groupings 2–5 illustrated in the FIGURE, or alternatively, for other types of gaming layouts, any of the active indicia on the layout mat or board. Similarly, while square shapes have been indicted by the solid lines illustrated in the FIGURE, other shapes, such as indicated by the dashed representations 52–56, may be used as well, as can any other two dimensional geometric configuration. Factually, all that is necessary is that an outline be provided which is capable of accommodating at least one or in some oases two die therein. Thus, even random shapes may be employed. In addition, as indicated by the dashed representation 58, one geometric shape may be placed within another in the concentric manner indicated or in an offset manner.

Also, as will be apparent from the FIGURE, grouped pairs of geometric shapes may typically be provided wherein one element of a group is relatively small in size to just barely accommodate a die while the other is substantially larger so that the same may accommodate a plurality of dice. This is done to provide two levels of jackpots wherein one is exceedingly difficult to achieve while the second is less difficult. In the FIGURE the more difficult jackpot area to achieve, due to the reduced size thereof, is set forth toward the right of the layout while an easier jackpot area to achieve is set forth to the left. Those of ordinary skill in the art will appreciate that the shooter in a Craps game will typically throw from the end and be required to bounce the dice off the dice table wall to the far end. Hence, any jackpot area in which a die lands occurs as result of the rebounding of the dice in precisely the same manner as point is made in playing the game of Craps. In games such as the game MONOPOLY or the like where the dice are merely thrown this rebound action would be unnecessary.

Alternatively, a jackpot of a certain size can be won if a certain number of sequential rolls of the dice land in the jackpot areas.

In use, the jackpot areas such as 8, 9, 10, and 11 are placed on the game layout in any desired location. Effectively, it is contemplated, that the locations for the jackpot areas 8–11 will be modified for each game layout utilized at a given location to provide varying configurations for each gaming table on which the instant invention is used. This provides desired variations for players and obviously prevents any expertise from being developed. The Craps game would be played in its normal manner; however, at anytime and/or during certain times when a die lands within one of the jackpot areas 8 or 9 and/or 10 and 11 a jackpot condition would result. At this time the shooter would recover the jackpot prize for the jackpot area in which the die rests.

In a casino environment it is contemplated that one or more craps tables would be provided with the jackpot areas illustrated in the FIGURE under conditions wherein either a minor premium would be charged for participation at a jackpot table or no premium would be charged. In the later case all Craps tables or all Craps tables in a given wagering range would be provided with jackpot areas. While any jackpot prize or specific configuration of jackpot areas 8–11 could be employed, it is presently considered that for an arrangement such as illustrated in the FIGURE jackpot areas 8 and 9 would have an extremely valuable prize associated therewith while jackpot area 10 and 11 would have a prize of significantly less value. Thus, for example, if the jackpot areas 8 and 9 were sized, as described above, so as to be slightly larger than a die face, the probability of a win is less than if the areas are larger. Here for instance, a major prize such as an automobile could represent a jackpot prize or a cash award of significant value. With respect to jackpot areas 10 and 11, wherein the probability of success is greater, lesser prize values would be assigned.

The rules associated with winning of the jackpot could also be varied to suit the preferences of the establishment. Thus, again in the exemplary case of a Craps arrangement such as indicated in the drawing, a jackpot win could be available anytime the dice are rolled or alternatively only during the Coming Out roll. Similarly, the manner in which a jackpot could be won could also be varied. Thus, for example if jackpot areas such as 8 and 9 are employed, only a single die could be required to fall within the jackpot area for purposes of winning a jackpot. However, in the case of jackpot areas such as illustrated as 10 and 11, or for that matter a circular area such as indicated by the dashed block 56, jackpot rules could require that both dice land within the jackpot area.

Similarly, if more than one die within a jackpot area were required, a jackpot area such as illustrated by the dashed block 53 could be employed in place of the jackpot areas indicted as 8 and 9 in the FIGURE. Alternatively, jackpot areas such as 53 could be employed in conjunction with jackpot areas 8 and 9 wherein the rules were tailored such that one jackpot is won if one die landed within jackpot areas 8 or 9 however; an even more significant jackpot could be provided if both dice landed within the jackpot area indicated by the dashed block 53. Yet another version would be a concentrically arranged pair of jackpot areas such as indicated by the dashed block 58 within the block 11. Here, if a die landed within the outline of the dashed block 58 a significant prize would be awarded while if the die came to rest within the block 11 but not fully within the dashed block 58 a lesser prize would be awarded.

Employing the same type of variations it will be readily recognized that circular shapes such as 54 and 56 as well as triangular shapes such as 52 and 55 could be employed as well. Furthermore, wholly irregular shapes could be employed such as the outline of a four leaf clover, a horse shoe, a rabbits foot or any other desired form which was deemed appropriate, it being noted that closed configurations are preferred to avoid any possibility of conflict. Alternatively, a predetermined location or locations on one or more of the betting possibility groupings 2-5 could be employed. Such a location could be provided with a gold background or the like to indicate that it is a jackpot area. Thus, for instance, any one of the numeral blocks in the place fields 24 or 24' could be employed for this purpose as could any of the blocks within the Hardway bet grouping 4 or the One Roll bet grouping 5.

Another location which particularly lends itself to this result are the Pays Double outlines present in the Field Box outlines 20 and 20'. Yet another variation would be to assign various values to the jackpot areas 8-10. Here, for example, the word Double could be selectively inscribed within one of the jackpot areas indicating that double the normal jackpot would be awarded if a die landed therein. Alternatively, numerals and/or letters and/or advertising could be employed to designate various jackpots or jackpot multiples. As an example, a Mercedes Benz could be shown in two jackpot areas so that if the dice landed in each area, the player would win a Mercedes Benz. This, also could be extended through use of the present invention as part of the existing field of play. Thus, for example if the block having the word SIX within the Place Field 24 and 24' were employed as a jackpot area the same could be colored gold to indicate the jackpot nature of the area and the term Double inserted therein to indicate a double jackpot or the like.

The marking or inscribing of jackpot areas in a gaming layout may be implemented through any conventional marking technique. Preferably, the marking of the jackpot areas will take place during the manufacture of the gaming layout mat or board per se, so that precisely the same techniques are employed for marking the jackpot areas as are utilized for the game layout mat or board. Thus, in the case of a Craps gaming layout, jackpot areas would be marked on the felt through silkscreening techniques or the like. Alternatively, the same could be later added by embossing felt material with known forms of inks or paints according to selected pattern and location information. The same approach could obviously be employed in the case of marking board games and the like.

The instant invention admits of additional variations which may be highly effective in casino environments and the like. Thus, for example, a Craps gaming layout mat once appropriately marked with jackpot areas may have pressure switch material affixed to the back of the felt underlying a jackpot area. Such pressure switch or pad material is available in configurations which are so thin as not to adversely effect the gaming layout mat by providing a bump or raised areas. The pressure switch material may then be connected through the table by means of a conventional switch arrangement so as to set off an alarm, gong or other audible arrangement when a die falls fully within a jackpot area. Thus, whenever a jackpot is obtained the loud audible arrangement initiated thereby would suitably pierce the surrounding area and provide an unmistakable indication that a jackpot had been won to call attention to this wonderful event. Other arrangements for automatically announcing the presence of a jackpot condition may also be employed.

Although the present invention has been described in connection with a highly specific exemplary embodiment thereof, it will be understood that many adaptations, modifications and variations thereof will be readily apparent and occur to those of ordinary skill in the art. Therefore, it is manifestly intended that this invention be only limited by the claims and the equivalents thereof.

What is claimed is:

1. A gaming layout having wagering possibilities, said layout comprising:

a flat surface having game indicia thereon corresponding to a conventional game having said wagering possibilities;

at least one marker;

a rebound surface transversely disposed to said flat surface for rebounding at least one said marker thrown thereagainst so as to indicate respective ones of said wagering possibilities from said at least one rebound marker in correspondence with said game indicia;

at least one defined area on said flat surface for receiving said at least one rebound marker, said at least one defined area being provided in addition to said game indicia of said conventional game, said at least one defined area being sufficiently large as to completely contain said at least one marker when said marker is at rest on said flat surface; and means for designating said at least one defined area a jackpot area when said at least one marker rebounds into and comes to rest in said at least one defined area.

2. The gaming layout according to claim 1 wherein said gaming layout is a CRAPS gaming layout and said at least one marker includes at least one die.

3. The gaming layout according to claim 1 wherein said at least one defined area is a closed area.

4. The gaming layout according to claim 3 wherein said closed area is slightly larger than a surface area defined by said at least one marker employed in playing said game when at rest on said flat surface.

5. The gaming layout according to claim 5 wherein a plurality of said defined areas are present on said first flat surface.

6. The gaming layout according to claim 5 wherein said gaming layout is a CRAPS gaming layout and said at least one marker includes at least one die.

7. The gaming layout according to claim 6 wherein at least one of said plurality of defined areas is slightly greater than a surface area of a side of a die employed in playing said game.

8. The gaming layout according to claim 7 wherein another of said plurality of said defined areas is a closed area representing a multiple of a surface area of a side of a die employed in playing said game.

9. The gaming layout according to claim 1 wherein said win condition for said jackpot is independent of said wagering possibilities for said game indicated.

10. The gaming layout according to claim 9 wherein said at least one defined area is a closed area.

11. The gaming layout according to claim 10 wherein said closed area is in the form of a regular geometric shape.

12. The gaming layout according to claim 11 wherein said gaming layout is a CRAPS gaming layout and said at least one marker includes at least one die.

13. The gaming layout according to claim 12 wherein said closed area is slightly larger than a surface area defined by a die employed in playing said game when at rest on said first surface.

14. The gaming layout according to claim 13 wherein a plurality of said defined areas are present on said first flat surface.

15. The gaming layout according to claim 14 wherein at least one of said plurality of defined areas is slightly greater than a surface area of a side of a die employed in playing said game.

16. The gaming layout according to claim 15 wherein another of said plurality of said defined areas is a closed area representing a multiple of a surface area of a side of a die employed in playing said game.

17. A gaming layout having gaming possibilities, said layout comprising:

a flat surface having game indicia thereon corresponding to a conventional game having said gaming possibilities;

at least one marker means for throwing on said flat surface to indicate respective ones of said gaming possibilities in accordance with said game indicia;

at least one defined area on said flat surface for receiving said at least one marker thrown on said flat surface, said at least one defined area being provided in addition to said game indicia of said conventional game, said at least one defined area being sufficiently large as to completely contain said at least one marker when said marker is at rest on said flat surface; and means for designating said at least one defined area a jackpot area when said at least one marker is thrown into and comes to rest in said at least one defined area.

18. The improved gaming layout according to claim 17 wherein said gaming layout is a CRAPS gaming layout and said markers are dice.

19. The improved gaming layout according to claim 18 wherein said closed area is slightly larger than a surface area defined by a die employed in playing said game when at rest on said first surface.

20. The improved gaming layout according to claim 18 wherein a plurality of said defined areas are present on said first flat surface.

21. The improved gaming layout according to claim 20 wherein at least one of said plurality of defined areas is slightly greater than a surface area of a side of a die employed in playing said game.

22. The improved gaming layout according to claim 21 wherein another of said plurality of said defined areas is a closed area representing a multiple of a surface area of a side of a die employed in playing said game.

23. The improved gaming layout according to claim 17 wherein the game consequences of said at least one marker means coming to rest in said jackpot area is independent of said gaming possibilities for said game indicated.

24. The improved gaming layout according to claim 23 wherein said closed area is in the form of a regular geometric shape.

25. The improved gaming layout according to claim 24 wherein said regular geometric shape is a square.

26. The improved gaming layout according to claim 24 wherein said regular geometric shape is a rectangle.

27. The improved gaming layout according to claim 24 wherein said regular geometric shape is a circle.

28. The improved gaming layout according to claim 24 wherein said regular geometric shape is a triangle.

* * * * *